US006338183B1

(12) United States Patent
Lang

(10) Patent No.: US 6,338,183 B1
(45) Date of Patent: Jan. 15, 2002

(54) ARRANGEMENT FOR CONDENSING A FIBER STRAND

(75) Inventor: Kurt Lang, Lauterstein (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/689,748

(22) Filed: Oct. 13, 2000

(30) Foreign Application Priority Data

Oct. 14, 1999 (DE) ..... 199 49 666

(51) Int. Cl.[7] ..... D01H 5/86
(52) U.S. Cl. ..... 19/244; 19/246; 19/150
(58) Field of Search ..... 19/150, 236–250, 19/252, 263, 286, 287, 288, 304, 305, 306, 307, 308; 57/264, 304, 315, 328, 333

(56) References Cited

U.S. PATENT DOCUMENTS

| | | | | | |
|---|---|---|---|---|---|
| 3,090,081 | A | * | 5/1963 | Klein | 19/288 |
| 4,475,272 | A | * | 10/1984 | Wood | 19/150 |
| 5,090,192 | A | * | 2/1992 | Stahlecker | 57/315 |
| 5,431,005 | A | * | 7/1995 | Fehrer | 57/315 |
| 5,600,872 | A | * | 2/1997 | Artzt et al. | 19/244 |
| 5,617,714 | A | * | 4/1997 | Fehrer | 57/315 |
| 6,052,872 | A | * | 4/2000 | Lang et al. | 19/288 |
| 6,073,314 | A | * | 6/2000 | Barauke | 19/246 |
| 6,082,089 | A | * | 7/2000 | Stahlecker | 57/315 |
| 6,108,873 | A | * | 8/2000 | Barauke | 19/246 |
| 6,161,258 | A | * | 12/2000 | Stahlecker | 19/246 |
| 6,170,126 | B1 | * | 1/2001 | Stahlecker | 19/246 |
| 6,185,790 | B1 | * | 2/2001 | Stahlecker | 19/246 |

FOREIGN PATENT DOCUMENTS

DE 44 26 278 2/1996

OTHER PUBLICATIONS

"Spinnovation" (Magazine), published by Spindelfabrik Suessen, Germany, No. 12, May 1999.

* cited by examiner

*Primary Examiner*—Danny Worrell
*Assistant Examiner*—Gary L. Welch
(74) *Attorney, Agent, or Firm*—Crowell & Moring LLP

(57) ABSTRACT

Downstream of a drafting unit of a spinning machine, a condensing zone is provided, in which a drafted fiber strand still in an untwisted state is condensed by bundling. The condensing zone comprises a stationary suction slit, over which the fiber strand to be condensed is transported by an air-permeable transporting element. The suction slit defines the direction of a suction air stream by a guiding edge, which extends diagonally to the direction of motion of the transport element. The air stream positions the fibers of the fiber strand diagonally to the direction of motion of the transport element and so condenses the fiber strand. The suction slit begins with a starting width, which seizes the fiber strand to be condensed in its entire width. Directly downstream thereof the suction slit graduates in the form of a delta into a narrower effective width. The guiding edge continues an edge of the delta without deformation.

32 Claims, 2 Drawing Sheets

A
b
10
α
a
18
d
24
25
11
B
e
β
16
15
c
17
20
12
22
C
14
13

ARRANGEMENT FOR CONDENSING A FIBER STRAND

BACKGROUND AND SUMMARY OF INVENTION

This application claims the priority of German Patent Document 199 49 666.8 filed Oct. 14, 1999, the disclosure of which is expressly incorporated by reference herein.

The present invention relates to an arrangement for condensing a fiber strand leaving a drafting unit, which fiber strand passes through a condensing zone in a twist-free state and is transported in the condensing zone, deposited on an air-permeable, moving transport element, over a stationary suction slit arranged diagonally to the direction of motion of the transport element, said suction slit defining the direction of a suction air stream by a guiding edge, which air stream positions the fibers of the fiber strand diagonally to the direction of motion of the transport element and so condenses the fiber strand.

An arrangement of this type is prior art in the technical magazine Spinnovation No. 5/99 from the Spindelfabrik Suessen, a German company. A woven fabric belt in the form of a narrow perforated transport belt serves here as a transport element, to whose direction of motion the suction slit extends slightly diagonally. The effective width of the suction slit is significantly larger than the width of the fiber strand in condensed state, and is constant for the whole width.

It is important for the pneumatic condensing of a fiber strand leaving a drafting unit that the fiber strand is transported in the condensing zone deposited on an air permeable transporting element in an untwisted state and having fibers lying essentially parallel to one another, and that in the condensing zone an air stream is generated which passes through the transport element, the width and/or direction of said air stream determining the degree of condensing, and positioning the fibers diagonally to the transport direction and thus bundling or condensing the fiber strand.

In practice it has been established that during pneumatic condensing a certain amount of fiber fly occurs and that in addition single fibers, in particular edge fibers of the fiber strand to be condensed, can wind themselves around a roller of the front roller pair when leaving the drafting unit.

It is an object of the present invention to ensure that as many fibers as possible of the fiber strand to be condensed are bundled in the condensing zone without any significant fiber fly occurring.

This object has been achieved in accordance with the present invention in that the suction slit begins with a starting width which encompasses the not yet condensed fiber strand on its entire width, and directly downstream thereof graduates, in the form of a delta, into a narrower effective width of the diagonal suction slit, whose guiding edge continues an edge of the delta without deformation.

It has been shown that in the case of an embodiment of the suction slit of this kind, all fibers, including the edge fibers of the delivered and to be condensed fiber strand are reliably seized, so that undesirable circulating fibers are avoided on the front roller pair of the drafting unit, and that practically no fiber fly arises which could escape from the condensing zone. This applies in particular when a certain amount of drafting tension of approximately 6% to 10% is to be produced during the condensing of the fiber strand.

The slight diagonal of the guiding edge serves the purpose of not only laterally bundling the fibers of the fiber strand to be condensed, but also, in connection with the direction of motion of the transport element, to impart a light false twist, which increases the bundling effect.

It is already known in German published patent application 44 26 278 to permit a suction slit of a condensing zone to begin with a relatively large initial width and then to permit the suction slit to taper delta-like and to continue with a narrower end width. At least half the entire length of this known suction slit, which is not arranged diagonally to the direction of motion of the transporting element, is taken up by the delta form. This measure serves a completely different purpose to the one in the present invention. The relatively long delta permits namely with its diagonal edges a traversing of the delivered fiber strand, whereby the edges of the suction slit are not arranged parallel to one another, but rather completely symmetrically triangle-like. The fiber strand is disposed alternatively during transversing on the right and on the left edge of the delta and subsequently transferred over to the end area of the slit which extends in a straight line to the transport element. In contrast, in the case of the present invention, the fiber strand to be condensed is disposed on the same edge throughout, namely on a guiding edge which extends diagonally to the direction of motion of the transport element.

Other objects, advantages and novel features of the present invention will become apparent from the following detailed description of the invention when considered in conjunction with the accompanying drawings.

DETAILED DESCRIPTION OF THE DRAWINGS

Figure 1:
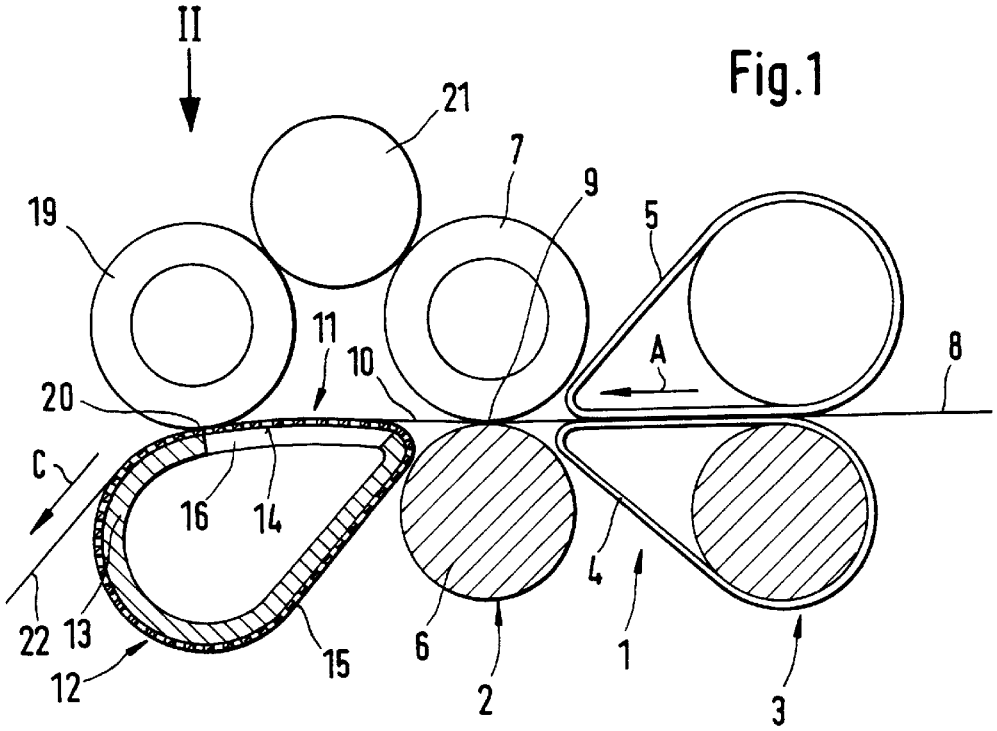
FIG. 1 is a partial sectional side view of an area of a condensing zone of a spinning machine, constructed according to a preferred embodiment of the present invention.

Of a drafting unit 1 of a spinning machine, in particular of a ring spinning machine, only the area of a front roller pair 2 and an apron roller pair 3 arranged upstream thereof is shown in FIG. 1. The apron roller pair 3 is looped in the known way by a lower apron 4 and by an upper apron 5, which feed the sliver or roving 8 to be drafted to the front roller pair 2. The latter comprises in a known way a driven front lower roller 6 extending along the length of the machine and also a front top roller 7 arranged at each spinning station. The sliver or roving 8 moving in transport direction A is drafted to the desired degree in the drafting unit 1. The drafting process ends at the front nipping line 9 of the drafting unit 1.

Figure 2:
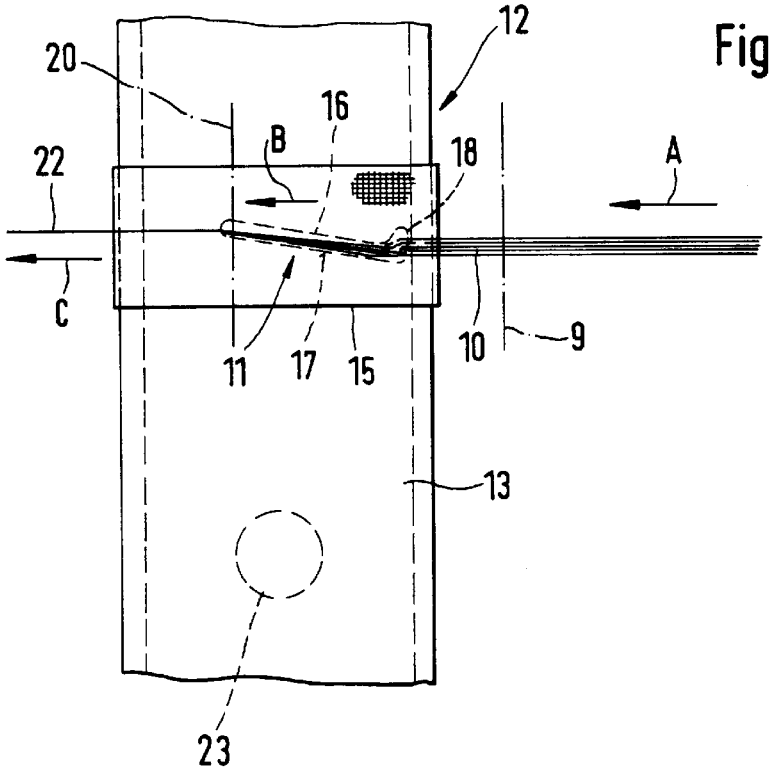
FIG. 2 is a view in the direction of the arrow II of FIG. 1 on the arrangement for condensing a fiber strand.

Directly downstream of the front nipping line 9, the now drafted fiber strand 10, still in a twist-free state as shown in FIGS. 1 and 2, travels through a condensing zone 11, which is a component part of an arrangement 12 for bundling or condensing the fiber strand 10. The arrangement 12 comprises a hollow profile 13 extending through a plurality of spinning stations, in which hollow profile 13 a vacuum exists. The outer contour of the hollow profile 13 is in the form of a sliding surface 14 for a transport element, in the present case for a circulating, air-permeable transport belt 15. This is preferably designed as a thin and fine-mesh woven belt and transports the fiber strand 10 through the condensing zone 11, whereby the fiber strand 10 is disposed during bundling or condensing on the transport belt 15 moving in transport direction B.

Figure 3:
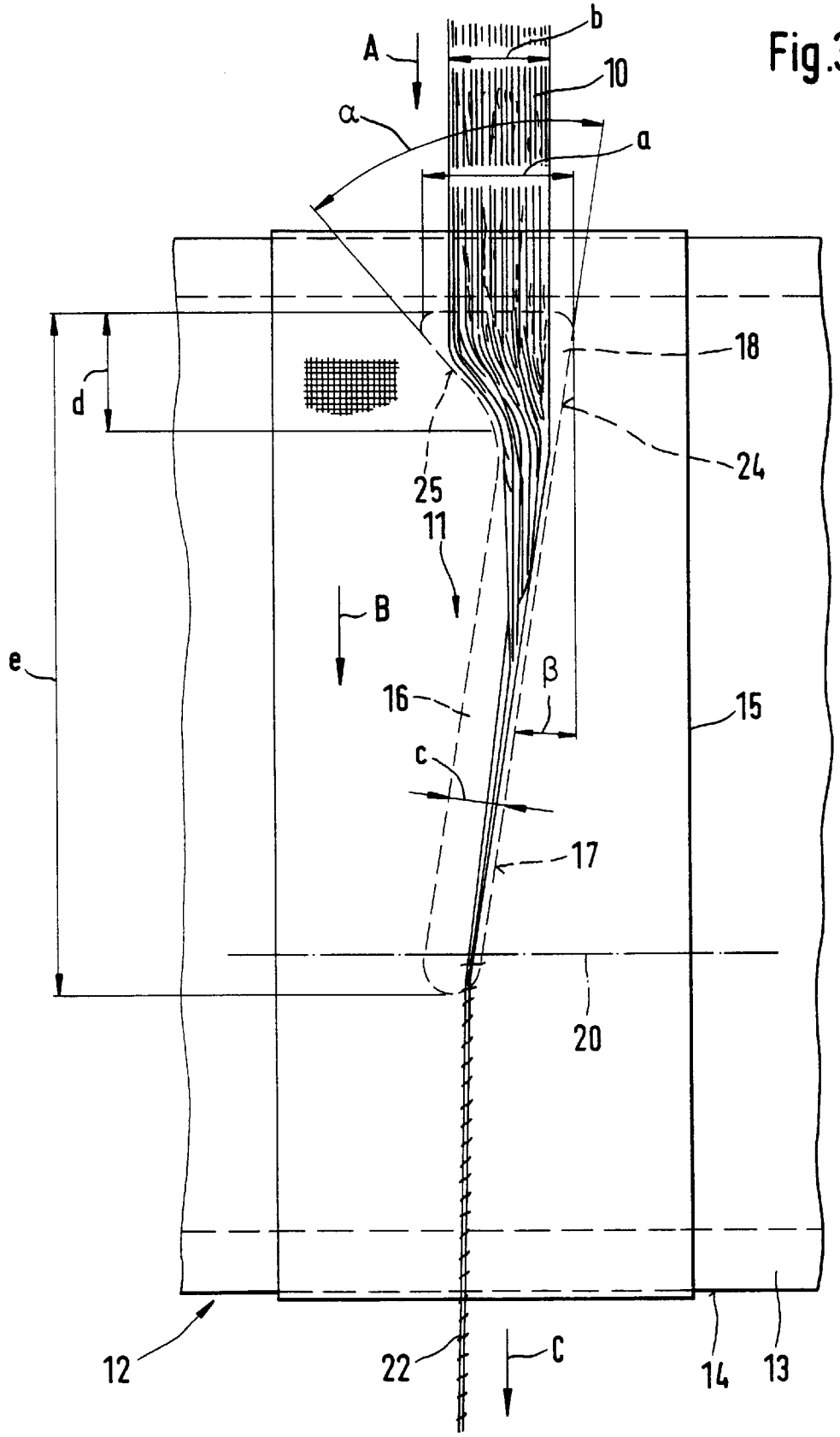
FIG. 3 is, in greatly enlarged dimensions, a partial view of FIG. 2 in the area of a suction slit in a condensing zone.

The fiber strand 10 is transported over a suction slit 16 located in the condensing zone 11; the function of said suction slit 16 is described with the aid of FIG. 3 in more detail below. The suction slit 16 comprises a guiding edge 17 which extends slightly diagonally to the direction of motion B of the transport belt 15; the suction slit 16 also comprises a delta 18 at its initial area which is described in more detail below.

The transport belt 15 is driven by a nipping roller 19, which is disposed with light pressure an the transport belt 15 and on the hollow profile 13 and which borders the condensing zone 11 at its exit side by a nipping line 20. The nipping line 20 serves as a twist block for the fiber strand 10 and prevents the twist to be applied to the thread 22 in a downstream twist zone from being retroactive back to the condensing zone 11. The twisted thread 22 is fed in delivery direction C to a twist device, for example a ring spindle (not shown).

The nipping roller 19 in turn receives its drive by a transfer roller 21 from the front top roller 7 of the drafting unit 1. The layout is chosen so that a certain desired drafting tension is exerted in the condensing zone 11 on the fiber strand 10.

For each machine section, for example for eight spinning stations, the hollow profile 13 comprises a suction source 23, which leads to a vacuum source.

With the aid of the enlarged FIG. 3 the invention is explained below. The reference points which were already used in connection with FIGS. 1 and 2 are retained, so that a repeat description is not necessary.

It is important for the pneumatic condensing of a fiber strand 10 leaving a drafting unit 1 that the fiber strand 10 is in a still twist-free state in the condensing zone 11 and comprises fibers essentially lying parallel to one another. In addition, the fiber strand 10 should be disposed during bundling or condensing on the air-permeable transport belt 15. In the condensing zone 11 a suction air stream is generated which passes through the transport belt 15, which air stream, due to its width and/or direction, determines the degree of condensing and which positions the fibers diagonally to the direction of motion B and thus bundles or condenses the fiber strand 10. The suction slit 16, which is arranged on the side of the transport belt 15 facing away from the fiber strand 10, defines, due to its guiding edge 17, which extends slightly diagonally to the direction of motion B of the transport belt 15, the suction air stream. The desired bundling of the fiber strand 10 is achieved in the present invention by diagonally positioning the suction slit 16, whereby its width is basically irrelevant and is essentially just sized according to the air consumption. The effective width c of the suction slit 16 must however be at least equally large or larger than the fiber strand 10 to be condensed, and at its end area exceed the width of the then condensed fiber strand.

In the case of pneumatic condensing the danger exists that some fibers of the fiber strand 10 to be condensed will leave the area of the suction slit 16 or even before being delivered thereto will wind themselves around a roller of the front roller pair 2 of the drafting unit 1. In order to prevent this, the starting width a of the suction slit 16 is such that it exceeds the width b of the not yet condensed fiber strand 10. Directly downstream thereof, however, the starting width a of the suction slit 16 graduates in the form of a delta 18 into the significantly narrower effective width c of the diagonal suction slit 16. The layout is such that the guiding edge 17 continues the preceeding edge 24 of the delta 18 without deformation, so that for the slant of the suction slit 16 and the bundling effected thereby, definite conditions exist. The other edge 25 of the delta 18 is, however, in comparison to the slant of the suction slit 16, significantly at an angle in form, so that the angle $\alpha$ of the delta 18 measures between 40° and 60°.

The starting width a should measure approximately 2.5 or 3.5 times the effective width c, whereby a starting width a of between 4 and 6 mm as well as an effective width c of between 1.5 to 2 mm have proven effective. For the length d of the delta 18, only about 2 to 3 mm are provided, at an overall length e of the suction slit 16 of at least four times the length d of the delta 18. In certain preferred embodiments the length of the delta measures approximately 20% of the overall length of the suction slit. The angle $\beta$, which defines the diagonal position of the guiding edge 17 of the suction slit 16 in relation to the direction of motion B of the transport belt 15, can, dependent on the staple length of the fiber material to be spun and of other parameters, vary greatly and measure between 30° and 18°.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for condensing a fiber strand leaving a drafting unit, which fiber strand passes through a condensing zone in a substantially twist-free state and is transported in the condensing zone on an air-permeable, moving transport element over a stationary suction slit arranged obliquely to the direction of motion of the transport element, said suction slit defining a suction air stream, which air stream positions the fibers of the fiber strand obliquely to the direction of motion of the transport element, wherein the suction slit includes:

a first section having a width greater than a not yet condensed fiber strand, a second section having a delta shape and adjoining the first section at a downstream side of the first section, said second delta shaped section narrowing in a downstream direction, and a third section downstream of and adjoining the second delta shaped section and having a width narrower than said first section, wherein the overall length of the suction slit is at least more than twice as long as the second delta shaped section.

2. An arrangement according to claim 1, wherein a starting width of the first section measures approximately 2.5 to 3.5 times an effective width of the third section.

3. An arrangement according to claim 2, wherein a starting width of the first section measures approximately 4 to 5 mm and the effective width of the third section measures approximately 1.5 to 2 mm.

4. An arrangement according to any claim 3, wherein the length of the second delta shaped section measures approximately between 2 to 3 mm.

5. An arrangement according to claim 4, wherein the delta shaped section includes a guiding edge which continues as a guiding edge of the third section without deflection of the guiding edge, and wherein an edge of the delta shaped section facing away from the guiding edge extends at an angle α in relation to the guiding edge measuring approximately between 40° to 60°.

6. An arrangement according to claim 3, wherein the delta shaped section includes a guiding edge which continues as a guiding edge of the third section without deflection of the guiding edge, and wherein an edge of the delta shaped section facing away from the guiding edge extends at an angle α in relation to the guiding edge measuring approximately between 40° to 60°.

7. An arrangement according to claim 3, wherein the length of the second delta shaped section measures approximately 20% of the overall length of the suction slit.

8. An arrangement according to any claim 2, wherein the length of the second delta shaped section measures approximately between 2 to 3 mm.

9. An arrangement according to claim 8, wherein the delta shaped section includes a guiding edge which continues as a guiding edge of the third section without deflection of the guiding edge, and wherein an edge of the delta shaped section facing away from the guiding edge extends at an angle α in relation to the guiding edge measuring approximately between 40° to 60°.

10. An arrangement according to claim 2, wherein the delta shaped section includes a guiding edge which continues as a guiding edge of the third section without deflection of the guiding edge, and wherein an edge of the delta shaped section facing away from the guiding edge extends at an angle α in relation to the guiding edge measuring approximately between 40° to 60°.

11. An arrangement according to claim 2, wherein the length of the second delta shaped section measures approximately 20% of the overall length of the suction slit.

12. An arrangement according to any claim 1, wherein the length of the second delta shaped section measures approximately between 2 to 3 mm.

13. An arrangement according to claim 12, wherein the delta shaped section includes a guiding edge which continues as a guiding edge of the third section without deflection of the guiding edge, and wherein an edge of the delta shaped section facing away from the guiding edge extends at an angle α in relation to the guiding edge measuring approximately between 40° to 60°.

14. An arrangement according to claim 12, wherein the length of the second delta shaped section measures approximately 20% of the overall length of the suction slit.

15. An arrangement according to claim 1, wherein the delta shaped section includes a guiding edge which continues as a guiding edge of the third section without deflection of the guiding edge, and wherein an edge of the delta shaped section facing away from the guiding edge extends at an angle α in relation to the guiding edge measuring approximately between 40° to 60°.

16. An arrangement according to claim 15, wherein the length of the second delta shaped section measures approximately 20% of the overall length of the suction slit.

17. An arrangement according to claim 1, wherein the length of the second delta shaped section measures approximately 20% of the overall length of the suction slit.

18. An arrangement according to claim 1, wherein the stationary suction slit is formed in a hollow profile, and wherein a nipping roller is disposed to press the fiber strand against the hollow profile at the third downstream section of the suction slit.

19. An arrangement according to claim 18, wherein a plurality of commonly driven spinning stations are provided with a common hollow profile.

20. An arrangement according to claim 1, wherein the overall length of the suction slit is at least four times as long as the second delta shaped section.

21. An arrangement according to claim 1, wherein the delta shaped section includes a guiding edge which continues as a guiding edge of the third section without deflection of the guiding edge.

22. A hollow profile member for supporting a movable air permeable transport element carrying a drafted member comprising:

a surface which in use faces the air permeable transport element and has a suction slit operable to control suction air acting on the transport element, wherein the suction slit comprises;

a first section having a width greater than a not yet condensed fiber strand, a second section having a delta shape and adjoining the first section at a downstream side of the first section, said second delta shaped section narrowing in a downstream direction, and a third section downstream of and adjoining the second delta shaped section and having a width narrower than said first section, wherein the overall length of the suction slit is at least more than twice as long as the second delta shaped section.

23. A hollow profile member according to claim 22, wherein the hollow profile member has a length operable to extend in use over a plurality of condensing sections with a corresponding plurality of said suction slits.

24. A hollow profile member according to claim 22, wherein the overall length of the suction slit is at least four times as long as the second delta shaped section.

25. A hollow profile member according to claim 22, wherein the delta shaped section includes a guiding edge which continues as a guiding edge of the third section without deflection of the guiding edge.

26. A hollow profile member according to claim 25, wherein a starting width of the first section measures approximately 2.5 to 3.5 times an effective width of the third section.

27. A hollow profile member according to claim 26, wherein a starting width of the first section measures approximately 4 to 5 mm and the effective width of the third section measures approximately 1.5 to 2 mm.

28. A hollow profile member according to claim 25, wherein a starting width of the first section measures approximately 4 to 5 mm and the effective width of the third section measures approximately 1.5 to 2 mm.

29. A hollow profile member according to claim 22, wherein a starting width of the first section measures approximately 2.5 to 3.5 times an effective width of the third section.

30. A hollow profile member according to claim 22, wherein a starting width of the first section measures approximately 4 to 5 mm and the effective width of the third section measures approximately 1.5 to 2 mm.

31. A hollow profile member according to claim 28, wherein the delta shaped section includes a guiding edge which continues as a guiding edge of the third section without deflection of the guiding edge, and wherein an edge of the delta shaped section facing away from the guiding edge extends at an angle $\alpha$ in relation to the guiding edge measuring approximately between 40° to 60°.

32. A hollow profile member according to claim 22, wherein the delta shaped section includes a guiding edge which continues as a guiding edge of the third section without deflection of the guiding edge, and wherein an edge of the delta shaped section facing away from the guiding edge extends at an angle $\alpha$ in relation to the guiding edge measuring approximately between 40° to 60°.

* * * * *